United States Patent [19]

Ishida et al.

[11] 4,084,899

[45] Apr. 18, 1978

[54] ELECTROSTATIC COPYING MACHINE

[75] Inventors: Tsutomu Ishida; Masaaki Nomura; Wasaburo Ohta, all of Tokyo, Japan

[73] Assignee: Ricoh Company, Ltd., Tokyo, Japan

[21] Appl. No.: 786,830

[22] Filed: Apr. 12, 1977

[30] Foreign Application Priority Data

Apr. 14, 1976 Japan ..... 51-42084

[51] Int. Cl.[2] ..... G03G 15/22

[52] U.S. Cl. ..... 355/14; 355/3 DD

[58] Field of Search ..... 118/7, 653, 657; 355/3 DD, 14; 427/18

[56] References Cited

U.S. PATENT DOCUMENTS 3,733,127 5/1973 Perlis et al. ..... 355/14 X

*Primary Examiner*—A. D. Pellinen

*Attorney, Agent, or Firm*—David G. Alexander

[57] ABSTRACT

An electrostatic image is formed on a rotating photoconductive drum and developed a number of times to form toner images which are transferred to respective copy sheets. The drum is rotated at a first speed for exposure and development of the first toner image and thereafter at a second higher speed for development of the subsequent toner images. A magnetic brush applies the toner substance to the drum, and is rotated at a third speed when the drum is rotated at the first speed and at a fourth speed which is higher than the third speed when the drum is rotated at the second speed, thereby applying more toner substance to the drum at the higher speed and maintaining the copy density constant. Alternatively or in combination, a bias voltage applied to the magnetic brush may be reduced at the higher drum speed, also resulting in the application of more toner substance to the drum.

4 Claims, 8 Drawing Figures

ELECTROSTATIC COPYING MACHINE

BACKGROUND OF THE INVENTION

The present invention relates to an electrostatic copying machine which repeatedly develops a single electrostatic image to form toner images which are transferred to respective copy sheets.

In a conventional electrostatic copying machine, a photoconductive drum or belt is electrostatically charged and radiated with a light image of an original document to form an electrostatic image thereof through localized photoconduction. A toner substance is applied to the drum which adheres to the dark or high potential areas of the electrostatic image to form a toner image. The toner image is transferred and fixed to a copy sheet to provide a permanent reproduction of the original document. Thereafter, the drum is discharged and any residual toner substance is removed therefrom. These operations are repeated for the production of each copy.

This conventional copying process has an inherent drawback where it is desired to make a number of copies of the same document. Due to the limited photoconductivity of commercially available photoconductive materials which are coated on the drums of copying machines to enable electrostatic photography, the exposure operation cannot be speeded up beyond a certain point. Although the exposure time can be reduced by the use of very high intensity illumination lamps, these lamps give off so much heat as to damage the original documents and adjacent components of the copying machine such as the glass platen which supports the documents.

Disclosed in Japanese patent publication Nos. 42-432, 44-30233 and 46-7786 is a method of overcoming the inherent speed limitation of the conventional copying process for making a number of copies of the same original document. The method comprises exposing the drum only once and repeatedly developing the resulting electrostatic image to form a plurality of toner images which are transferred to respective copy sheets. This method allows a substantial increase in the copying speed since development and transfer can be performed at a higher speed than exposure. The use of a toner substance comprising toner particles and carrier particles of suitable formulation prevents excessive discharge of the electrostatic image due to electrical conduction between the drum and developing unit through the toner substance. Rather than using pure iron particles for the carrier, the use of iron particles coated with an electrically insulative resin or ferrite particles is preferred due to their lower electrical conductivity. Development may be performed by means of powder crowding, cascade, a fur brush or a magnetic brush.

A problem has remained heretofore unsolved in that an increase in the developing speed results in underdevelopment, or copies of insufficient density. Although various expedients have been introduced to control the copy density in this type of multiple development operation, none have proven successful.

SUMMARY OF THE INVENTION

In accordance with the present invention an electrostatic image is formed on a rotating photoconductive drum and developed a number of times to form toner images which are transferred to respective copy sheets. The drum is rotated at a first speed for exposure and development of the first toner image and thereafter at a second higher speed for development of the subsequent toner images. A magnetic brush applies the toner substance to the drum, and is rotated at a third speed when the drum is rotated at the first speed and at a fourth speed which is higher than the third speed when the drum is rotated at the second speed, thereby applying more toner substance to the drum at the higher speed and maintaining the copy density constant. In one form of the invention, a bias voltage applied to the magnetic brush is reduced at the higher drum speed, also resulting in the application of more toner substance to the drum.

It is an object of the present invention to provide an electrostatic copying machine which repeatedly develops a single electrostatic image to form toner images which are transferred to respective copy sheets in which the printing density is effectively maintained constant.

It is another object of the present invention to provide a generally improved electrostatic copying machine.

Other objects, together with the foregoing, are attained in the embodiments described in the following description and illustrated in the accompanying drawing.

DESCRIPTION OF THE PREFERRED EMBODIMENTS

While the electrostatic copying machine of the invention is susceptible of numerous physical embodiments, depending upon the environment and requirements of use, substantial numbers of the herein shown and described embodiments have been made, tested and used, and all have performed in an eminently satisfactory manner.

Figure 1:
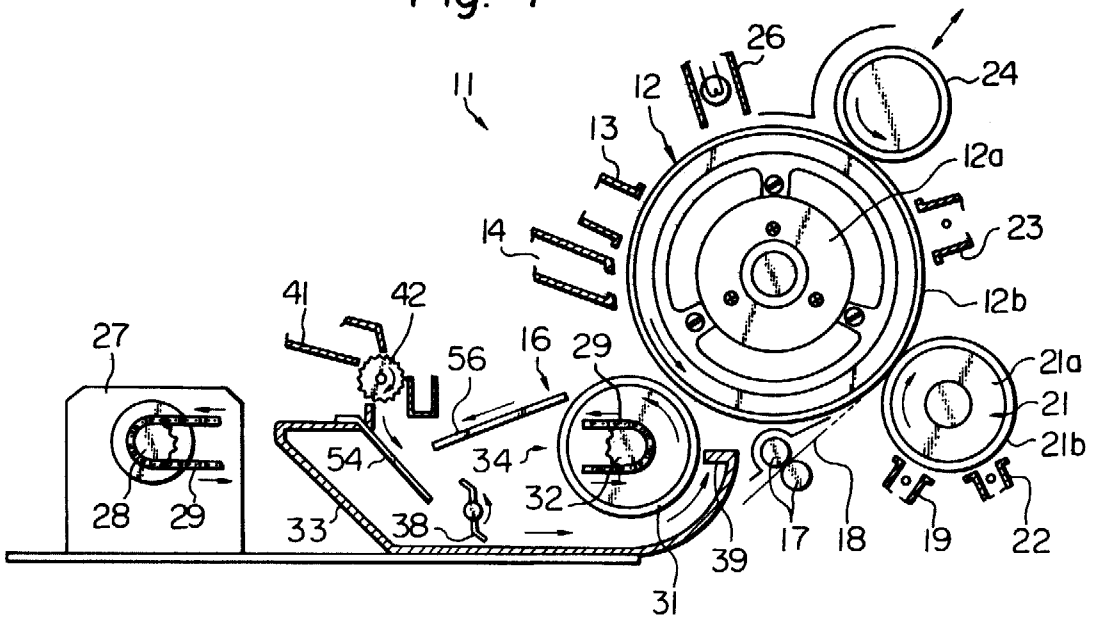
FIG. 1 is a schematic view of an electrostatic copying machine embodying the present invention.

Referring now to FIG. 1 of the drawing, an electrostatic copying machine embodying the present invention is schematically shown and designated by the reference numeral 11. The copying machine 11 comprises a photoconductive drum 12 which is rotated counterclockwise and formed of a grounded metal cylindrical core **12*a* on the periphery of which is formed a coating 12*b* of a photoconductive material. A corona charging unit 13 is provided adjacent to the periphery of the drum 12 to apply an electrostatic charge thereto. Although not shown in detail, an exposure unit 14 is provided to focus a light image of an original document onto the drum 12** to form an electrostatic image thereon through localized photoconduction. A developing unit 16 applies a toner substance to the drum 12 to develop the electrostatic image and thereby form a toner image. A sheet feed unit which is shown in simplified form as a pair of feed rollers 17 feeds a copy sheet 18 into engagement with the drum 12. A charger 19 applies an electrostatic charge to the surface of a transfer roller 21 which lightly presses the copy sheet 18 into engagement with the drum 12. Whereas the drum 12 is initially charged with a positive polarity by the charging unit 13, the toner substance is given a negative charge in the developing unit 16 thereby adhering to the drum 12 by electrostatic attraction. The charge on the transfer roller 21 is also positive and has a high enough magnitude to attract the toner substance from the drum 12 onto the copy sheet 18 by electrostatic attraction through the copy sheet 18. A fixing unit (not shown) fixes the toner image to the copy sheet 18 by heat, pressure or a combination thereof although not shown. A discharger 22 is provided to neutralize the charge on the transfer roller 21 prior to recharging by the charger 19. Typically, the transfer roller 21 is formed of an electrically conductive rubber core 21*a*, the surface of which is coated with a dielectric 21*b*. The transfer roller 21 is rotated clockwise at the same surface speed as the drum 12.

After transfer a corona discharge unit 23 is energized to neutralize the electrostatic charge on the drum 23 prior to recharging by the charging unit 13. A cleaning brush 24 is rotated counterclockwise in brushing engagement with the drum 12 to remove any residual toner substance therefrom and a lamp 26 is energized to uniformly illuminate the drum 12 and ensure complete discharge thereof.

Figure 2:
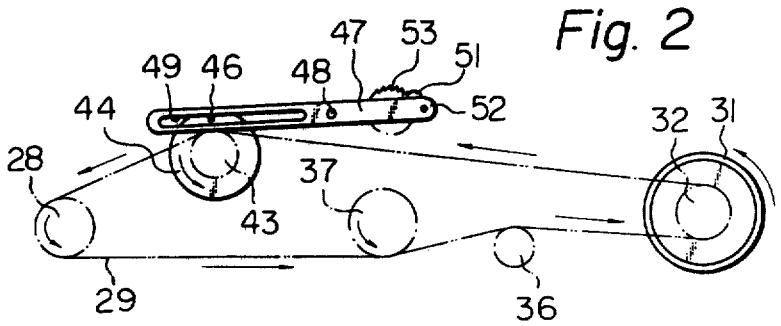
FIG. 2 is a schematic view showing a drive system for a developing unit of the copying machine.

Referring in combination to FIGS. 1 and 2, the developing unit 16 comprises a drive motor 27. A sprocket 28 is fixed to the shaft (not designated) of the motor 27 around which is trained a drive chain 29. A cylinder 31 of a non-magnetic material is mounted on a shaft (not designated) for integral driving rotation by a sprocket 32 around which the chain 29 is trained. Although not shown, permanent magnets are mounted inside the cylinder 31. The lower portion of the cylinder 31 is immersed in toner substance provided in a developing tank 33. Counterclockwise rotation of the sprockets 28 and 32 and chain 29 causes counterclockwise rotation of the cylinder 31. Due to the attraction of the magnets, the toner substance is picked up by the cylinder 31 and rotates counterclockwise therewith in brushing contact with the drum 12. This assembly is known in the art as a magnetic brush and is generally designated as 34. Due to the brushing engagement of the magnetic brush 34 with the drum 12, the electrostatic image is developed to form a toner image.

The chain 29 is further drivingly trained around an idler sprocket 36 and a sprocket 37 to which is fixed an impeller 38. Rotation of the impeller 38 causes the toner substance in the developing tank 33 to be homogenized. A doctor blade 39 removes excess toner substance from the magnetic brush 34 and returns the same to the developing tank 33.

Fresh toner substance for repenishment is introduced into a hopper 41, the lower end of which opens onto a serrated cylinder 42. The chain 29 is further trained around a sprocket 43 which is integrally rotatable with a crankshaft 44. A crankpin 46 is attached to the crankshaft 44 radially spaced from the center thereof.

A pawl arm 47 is pivotally mounted about a pin 48 and is formed with a longitudinal slot 49 in which the crankpin 46 slidingly engages. A pawl 51 is pivotally attached to the right end of the arm 47 by means of a pin 52. The pawl 51 operatively engages with a ratchet 53 which is fixed to the wheel 42.

Rotation of the crankshaft 44 causes rocking movement of the arm 47 about the pin 48. Each time the arm 47 rocks clockwise the pawl 51 advances the ratchet 53 and wheel 42 in the same direction to feed a new charge of toner substance into the developing tank 33 down a chute 54. A scraper blade 56 engages with the cylinder 31 to remove all toner substance therefrom after the magnetic brush 34 engages with the drum 12. This toner substance slides down the blade 56 onto the chute 54 on which it is mixed with the fresh toner substance and falls into the developing tank 33.

For making a single copy of an original document the copying machine 11 functions in the manner described hereinabove. However, the copying process can be speeded up considerably for making more than one copy of an original document as follows.

To make the first copy, the drum 12 is exposed to form an electrostatic image which is developed by the magnetic brush 34 to form a toner image. This first toner image is transferred to a copy sheet. During this first revolution of the drum 12 the discharge unit 23 and lamp 26 are deenergized. Furthermore, the cleaning brush 24 is moved away from the drum 12. The subsequent copies are made by repeatedly developing the electrostatic image and transferring the toner images formed to copy sheets in respective revolutions of the drum 12. After the final transfer operation the discharge unit 23, cleaning brush 24 and lamp 26 are utilized to discharge the drum 12 and remove any residual toner substance therefrom.

This process allows a speedup of the copying operation since the developing and transfer steps can be performed at higher speed than the exposure step. Thus, after the first transfer operation, the rotational speeds of the drum 12 and transfer roller 21 are increased by the same amount, and subsequent development and transfer operations carried out at increased speed and therefore in less time.

Figure 6:
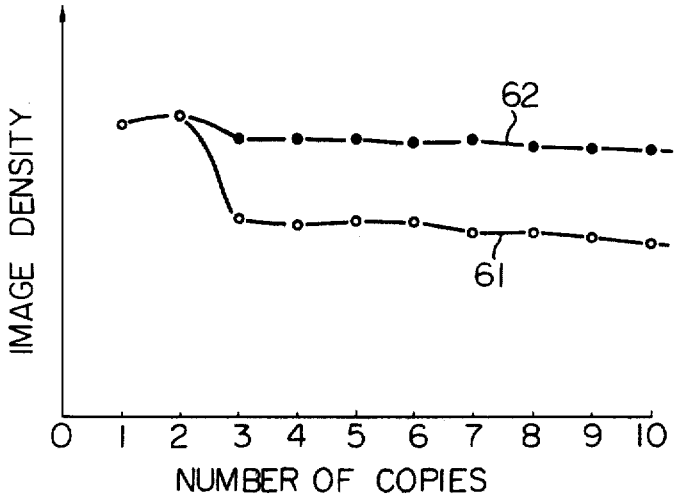
FIG. 6 is a graph illustrating the performance of the present invention compared to the prior art.

However, a problem arises when the drum 12 speed is increased in that the image density of the copies is decreased as illustrated by a curve 61 in FIG. 6. The copy production rate was 15 copies per minute for the first copy and was increased to 45 copies per minute for the second and subsequent copies. In other words, the copy speed was tripled. Examination of the curve 61 will disclose that the image density is considerably reduced for the third copy and remains relatively constant thereafter. A satisfactory means for overcoming this problem has not been proposed heretofore.

Figure 5:
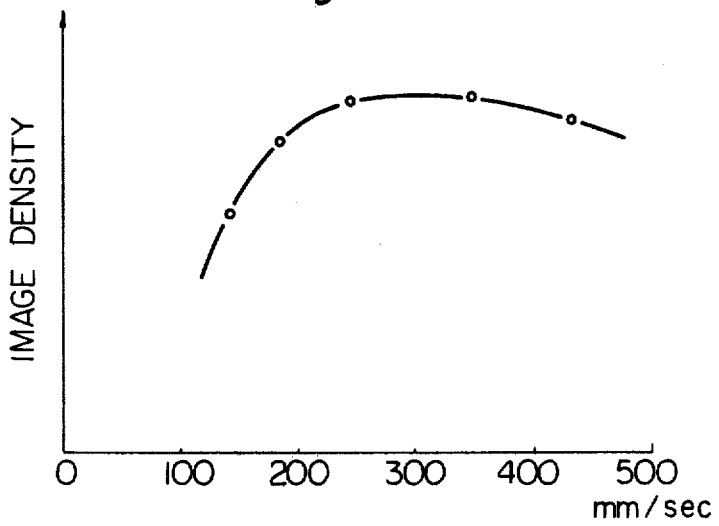
FIG. 5 is a graph illustrating the copy density as a function of magnetic brush rotational speed for a conventional copying process.

FIG. 5 illustrates the principle of the present invention. The curve shown in this Figure shows how the image density can be increased by increasing the rotational speed of the cylinder 31 from the magnetic brush 34. The linear velocity is obtained from the number of revolutions per minute and the circumference of the cylinder 31. The curve is for a conventional copying process in which the drum 12 is exposed for each copy. It can be seen from the curve that the image density at 300mm/sec is about double that at 100mm/sec.

This principle is effectively applied in accordance with the present invention as illustrated by a curve 62 in FIG. 6. With all other conditions the same as for the curve 61, the curve 62 shows how the image density is maintained substantially constant by rotating the cylinder 31 at a surface speed of 150mm/sec for the first copy and at 250mm/sec for the second and subsequent copies.

Figure 3:
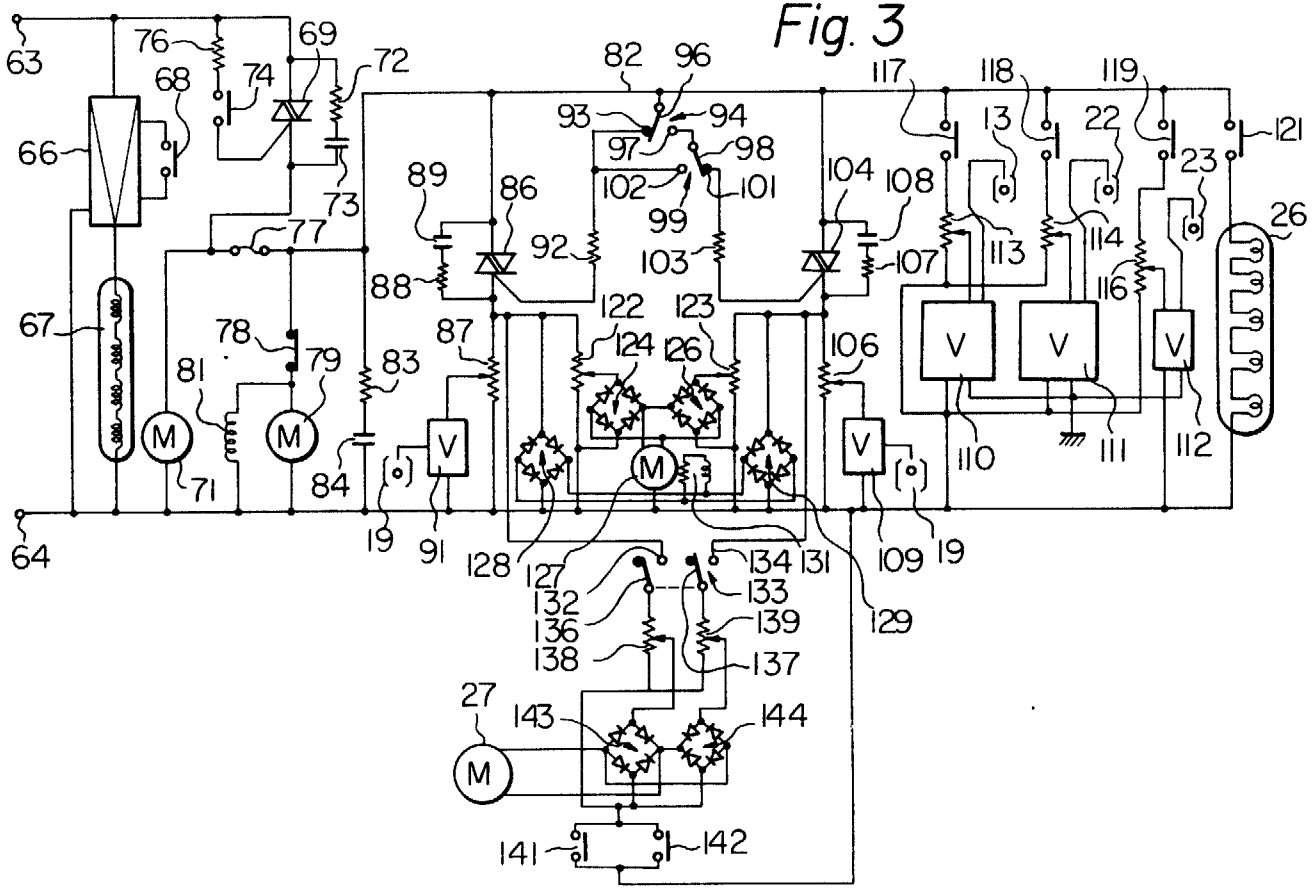
FIG. 3 is an electrical schematic diagram of the copying machine.

FIG. 3 is an electrical schematic diagram of the copying machine 11 comprising means for controlling the rotational speeds of the drum 12 and cylinder 31 in the manner illustrated by the curve 62 in FIG. 6. In FIG. 3, input lines for AC excitation are designated as 63 and 64. A drive unit 66 for the exposure unit 14 is connected across the lines 63 and 64. An exposure lamp 67 is connected between the drive unit 66 and the line 64. A normally open switch 68 is connected to control the drive unit 66.

Connected across the lines 63 and 64 in a series arrangement are a triac 69 and a motor 71 for driving the feed rollers 17. A resistor 72 and capacitor 73 are connected in series across the triac 69. Furthermore, a normally open switch 74 and a resistor 76 are connected in series between the line 63 and the gate of the triac 69.

Connected in parallel with the motor 71 in a series arrangement are a fuse 77, a normally closed switch 78 and a motor 79 for rotating the cleaning brush 24. Connected in parallel with the motor 79 is a solenoid 81 which, when energized, moves the cleaning brush 24 into contact with the drum 12.

A line 82 is connected to the junction of the fuse 77 and switch 78. A resistor 83 and capacitor 84 are connected in series between the line 82 and the line 64. Further connected in series between the lines 82 and 64 are a triac 86 and a potentiometer 87. A resistor 88 and capacitor 69 are connected in series across the triac 86. The slider of the potentiometer 87 is connected to control a voltage source 91 for the charging unit 19.

The gate of the triac 86 is connected through a resistor 92 to a fixed contact 93 of a switch 94. A movable contact 96 of the switch 94 which is connected to the line 82 normally engages with the fixed contact 93. Another fixed contact 97 of the switch 94 is connected to a movable contact 98 of a switch 99. The movable contact 98 normally engages with a fixed contact 101 of the switch 99. Another fixed contact 102 of the switch 99 is connected to the fixed contact 93 of the switch 94.

The fixed contact 101 is connected through a resistor 103 to the gate of a triac 104 which is connected across the lines 82 and 64 in series with a potentiometer 106. A resistor 107 and capacitor 108 are connected in series across the triac 104. The slider of the potentiometer 106 is connected to control a voltage source 109 which is also used to power the charging unit 19.

Power sources 110, 111 and 112 for the chargers 13, 22 and 23 are connected to said respective components and are also connected to ground and the line 64. The power sources 110, 111 and 112 are connected to the sliders of potentiometers 113, 114 and 116 respectively which are connected at one end to the line 64. The other ends of the potentiometers 113, 114 and 116 are connected through normally open switches 117, 118 and 119 respectively to the line 82. The lamp 26 is connected in series with a normally open switch 121 across the lines 82 and 64.

Connected in parallel with the potentiometers 87 and 106 are potentiometers 122 and 123 respectively. Inputs of full wave bridge rectifiers 124 and 126 are connected between the sliders of the potentiometers 122 and 123 respectively and the line 64. Each of the rectifiers 124 and 126 comprises four diodes which are not individually designated by reference numerals. Outputs of the rectifiers 124 and 126 are connected in parallel across a rotor of a motor 127 which rotatingly drives the drum 12 and transfer roller 21 in interlocked relation. The rotor of the motor 127 is also connected to the line 64.

Inputs of full wave bridge rectifiers 128 and 129 are connected across the potentiometers 87 and 106 respectively, outputs of the rectifiers 128 and 129 being connected in parallel across a stator winding 131 of the motor 127.

The junction of the potentiometer 87 and triac 86 is connected to a fixed contact 132 of a switch 133. The junction of the potentiometer 106 and triac 104 is connected to a fixed contact 134 of the switch 133. Movable contacts 136 and 137 of the switch 133 do not normally engage with the contacts 132 and 134 but are connected through potentiometers 138 and 139 and a parallel combination of normally open switches 141 and 142 to the line 64.

Inputs of bridge rectifiers 143 and 144 are connected between the sliders of the potentiometers 138 and 139 respectively and the parallel combination of the switches 141 and 142. Outputs of the rectifiers 143 and 144 are connected in parallel to the motor 27 for the developing unit 16.

The switches illustrated in FIG. 3 normally assume the positions shown and are changed over by means of a motor driven controller which is not shown. The controller typically comprises a motor and a plurality of cams fixed to the motor shaft. The cams engage with the switches to actuate the same in the required sequence and for the required length of time.

Figure 4:
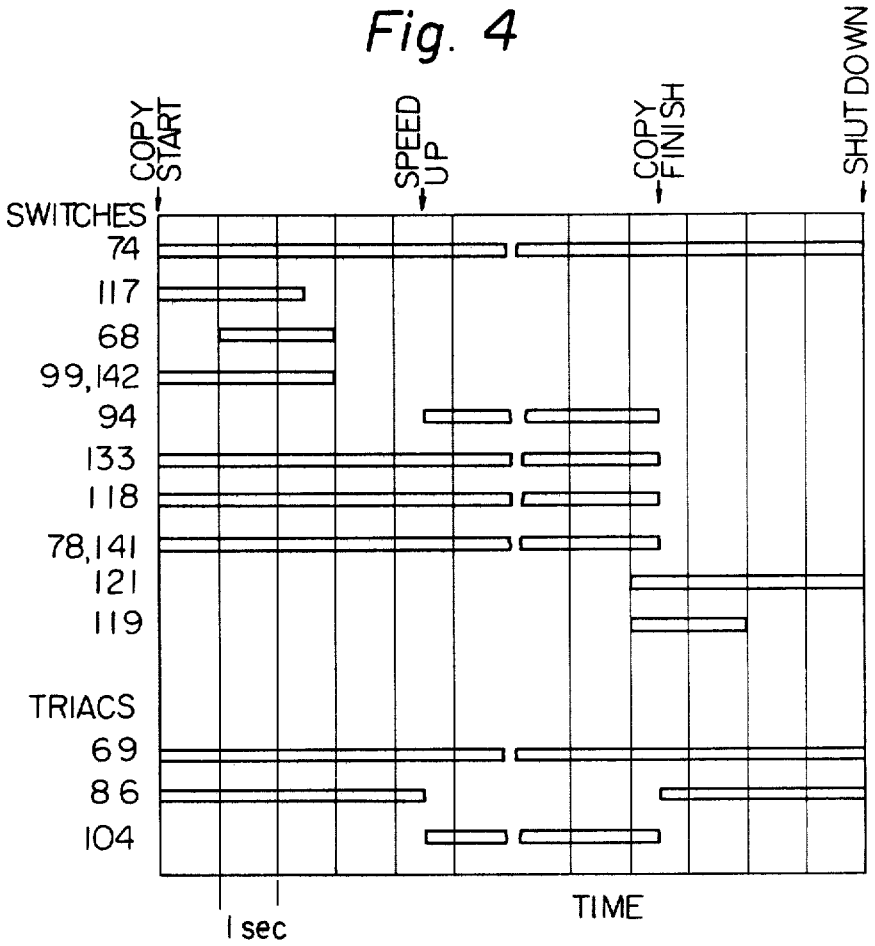
FIG. 4 is a timing diagram of the operation of the copying machine.

The operation of the electrical circuit of FIG. 3 will now be described with reference being made to the timing chart of FIG. 4. The bars in FIG. 4 indicate that the switches are changed over from their normal positions shown in FIG. 3 or that the triacs are rendered conductive.

At the initiation of copying, the switch 74 is closed thereby connecting the gate of the triac 69 to the line 63 through the resistor 76. This turns on the triac 69 which connects the line 82 to the line 63. The switch 117 is closed, connecting the line 82 to the power source 110 and energizing the charging unit 13. The switch 117 opens after the drum 12 has been completely charged. The switch 99 is changed over so that the movable contact 98 engages with the fixed contact 102 preventing the resistor 103 from being connected to the line 82. The switch 142 is closed in addition to the switch 133. With the switch 94 in the normal position, the gate of the triac 86 is connected to the line 82 through the resistor 92 turning on the triac 86. The potentiometer 138 is connected across the lines 82 and 64 through the triac 86, switch 133 and switch 142 thereby energizing the motor 27 to rotate the magnetic brush 34. More specifically, the triac 104 is turned off and no voltage appears at the slider of the potentiometer 139. However, the voltage at the slider of the potentiometer 138 is applied to the motor 27 to drive the same.

The slider of the potentiometer 138 is adjusted in such a manner that the voltage applied therefrom through the rectifier 143 to the motor 27 causes the same to drive the cylinder 31 at a surface speed of 150mm/sec. In a similar manner, the slider of the potentiometer 122 is adjusted so that the voltage applied therefrom through the rectifier 124 to the rotor of the motor 127 causes the motor 127 to rotate the drum 12 and transfer roller 21 at a speed corresponding to 15 copies per minute. It will be noted that the triac 104 is turned off and no voltage is applied therethrough to the potentiometer 123.

At the initiation of copying the switch 78 is opened thereby de-energizing the motor 79 and solenoid 81. This causes the cleaning brush 24 to be moved away from the drum 12 and stopped. The switch 141 is closed holding the connection of the motor 27 to the line 64 after the switch 142 is opened. After a suitable period of time the switch 99 is changed over allowing the gate of the triac 104 to be connected to the line 82 through the resistor 103 at a subsequent time when the switch 94 is changed over.

At about one second after initiation of copying the switch 68 is closed for a suitable length of time thereby energizing the drive unit 66 and lamp 67. The lamp 67 illuminates an original document for exposure and the drive unit 66 produces a scanning operation of the document, although the components for achieving these operations are known in the art and are not shown.

The switch 118 is also closed thereby energizing the discharger 22 for the transfer drum 21 by means of the voltage source 111. It will be noted that the switches 119 and 121 are open so that the discharge unit 23 and the lamp 26 are de-energized.

The potentiometer 87 is connected across the lines 82 and 64 through the triac 86. The voltage at the slider of the potentiometer 87 is applied to the voltage source 91 thereby controlling the same to apply a suitable electrostatic charge or bias voltage to the transfer roller 21.

In summary, the drum 12 and transfer roller 21 are rotated at a speed corresponding to 15 copies per minute and the cylinder 31 is rotated at a surface speed of 150mm/sec. The drum 12 is charged by the charging unit 13 and exposed with a light image of an original document through energization of the drive unit 66 thereby forming an electrostatic image on the drum 12. The feed rollers 17 are energized to feed the copy sheet 18 into engagement with the drum 12 after the electrostatic image is developed by the magnetic brush 34. A suitable bias voltage is applied to the transfer roller 21 by the charger 19 and the discharger 22 is energized to neutralize the transfer roller 21 prior to recharging. The cleaning brush 24 is stopped and moved out of engagement with the drum 12. The discharger 23 and lamp 26 are de-energized.

After the first transfer operation is completed the switch 94 is changed over connecting the gate of the triac 104 to the line 82 through the switches 94 and 99 and the resistor 103. This turns on the triac 104 and turns off the triac 86. The voltages at the outputs of the rectifiers 124, 128 and 143 become zero.

The slider of the potentiometer 123 is adjusted so that the voltage applied therefrom through the rectifier 126 to the motor 127 causes the same to drive the drum 12 and transfer roller 21 at a speed corresponding to 45 copies per minute. Similarly, the voltage at the slider of the potentiometer 139 is adjusted to be such as to energize the motor 27, through the rectifier 144, to drive the cylinder 31 of the magnetic brush 34 at a speed of 250mm/sec., in accordance with the curve 62 of FIG. 6. Thus, both the drum 12 and cylinder 31 are driven at higher respective speeds so that although subsequent developing and transfer operations are performed at increased speed the copy image density remains constant.

The voltage at the slider of the potentiometer 106 controls the voltage source 109 to apply the correct charge potential to the transfer roller 21 which corresponds to the increased transfer roller speed.

As the last transfer operation is completed the switch 94 is changed back to the illustrated position thereof turning off the triac 104 and turning on the triac 86. This has the effect of restoring the speeds of the drum 12, transfer roller 21 and cylinder 31 to their respective lower values. Just before finishing the last transfer operation the switches 119 and 121 are closed thereby energizing the discharging unit 23 and lamp 26 respectively. Also at the finish of the last transfer operation the switches 133, 118, 78 and 141 are returned to their normal positions. Closure of the switch 78 energizes the solenoid 81 and motor 79 to move the cleaning brush 24 into engagement with the drum 12 and rotate the cleaning brush 24 to clean the drum 12.

After the entire copying and drum cleaning operations are completed the switch 74 is opened turning off the triac 69 and shutting down the entire copying machine 11.

In accordance with another feature of the present invention the copy density may be maintained constant through variation of a bias voltage applied to the cylinder 31. In order to prevent the white background areas of the copies from printing gray, a bias voltage which is of the same polarity and slightly smaller in magnitude than the potential of the white areas of the electrostatic image on the drum 12 is applied to the cylinder 31. Alternatively or in combination with increasing the rotational speed of the cylinder 31, the bias voltage applied thereto may be lowered to maintain the copy image density constant against the increased rotational speed of the drum 12.

Figure 7:
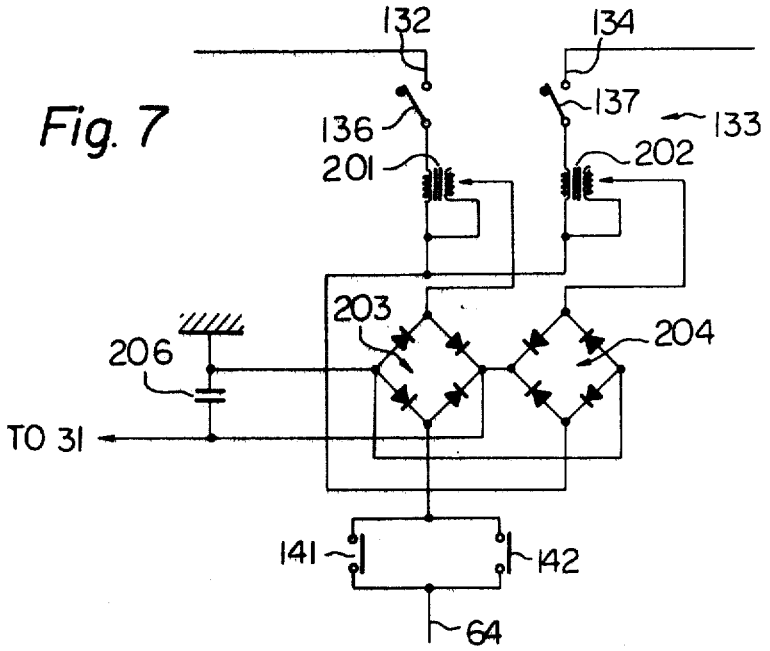
FIG. 7 is an electrical schematic diagram illustrating a modified embodiment of the present invention.

Circuitry to perform this function is illustrated in FIG. 7. Primary windings of variable transformers 201 and 202 are connected between the movable contacts 136 and 137 respectively of the switch 133 and the parallel combination of the switches 141 and 142. One end of each of the secondary windings of the transformers 201 and 202 are also connected to the parallel combination of the switches 141 and 142. On other ends of the secondary windings of the transformers 201 and 202 are constituted by sliders, thereby providing variable secondary voltages. Inputs of bridge rectifiers 203 and 204 are connected between the sliders of the transformers 201 and 202 respectively and the parallel combination of the switches 141 and 142. Outputs of the rectifiers 203 and 204 are connected in parallel across a filter capacitor 206, one end of which is grounded. The ungrounded end of the capacitor 206 is connected to the cylinder 31 to apply a bias voltage thereto.

In operation, the transformer 201 is energized for low speed operation with the triac 86 turned on. The slider voltage of the transformer 201 applied to the cylinder 31 is adjusted to be suitable for the first copy. For the second and subsequent copies, the transformer 201 is de-energized and the transformer 202 is energized through the triac 104. The slider voltage of the transformer 202 is selected so that the bias voltage applied therefrom to the cylinder 31 will be lowered at the higher drum speed so that the copy image density is increased over that which would be produced at the higher bias voltage. The lowered bias voltage is selected so that the copy image density is the same for subsequent copies as for the first copy.

Figure 8:
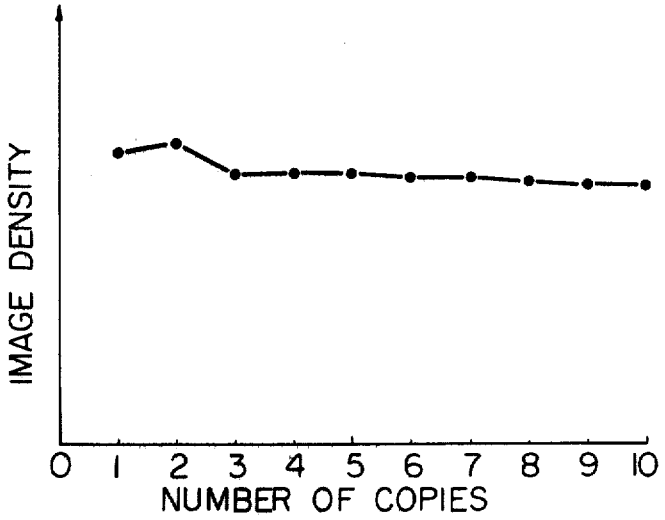
FIG. 8 is a graph illustrating the performance of another modified embodiment of the present invention.

FIG. 8 illustrates the operation of the embodiment of FIG. 7, which varies the bias voltage but not the cylinder 31 speed. In this curve the speed of the drum 12 corresponded to 15 copies perminute for the first copy and 30 copies per minute for subsequent copies. The speed of the cylinder 31 was maintained constant at 150mm/sec. The bias voltage applied to the cylinder 31 was +250V for the first copy and +100V for subsequent copies. The potential of the electrostatic image on the drum 12 in the darkest areas thereof was about +700V. It will be seen that the copy image density was maintained substantially constant for all copies.

In summary, the present invention provides an electrostatic copying machine which increases the copying speed in multiple copying operations while maintaining the copies uniform in density. Various modifications will become possible for those skilled in the art after receiving the teachings of the present disclosure without departing from the scope thereof. For example, the drum 12 may be replaced by an endless belt having a photoconductive coating. The invention may also be applied to an electrostatic process for copying or recording which transfers an electrostatic image from a photoconductive member to a copy sheet and develops the image on the copy sheet. Other means than those particularly shown may also be utilized to increase the amount of toner supply in accordance with the rotational speed of the drum, such as increasing the toner recirculation rate, within the scope of the present invention.

What is claimed is:

1. An electrostatic copying machine comprising:

a rotary photoconductive drum;

exposure means for forming an electrostatic image on the drum;

developing means for applying a toner substance to the drum to develop the electrostatic image and form toner images;

transfer means for transferring the toner images to respective copy sheets;

drum drive means for rotating the drum at a first speed for exposure and development of said electrostatic image to form a first toner image and at a second speed which is higher than the first speed for development of said electrostatic image to form subsequent toner images; and, development control means for controlling the developing means to apply the toner substance to the drum in an amount corresponding to the drum rotational speed.

2. A copying machine as in claim 1, in which the development control means controls the developing means to apply more toner substance to the drum when the drum is rotated at the second speed than when the drum is rotated at the first speed.

3. A copying machine as in claim 2, in which the developing means comprises a magnetic brush, the development control means controlling the magnetic brush to be rotated at a third speed when the drum is rotated at the first speed and controlling the magnetic brush to be rotated at a fourth speed which is higher than the third speed when the drum is rotated at the second speed.

4. A copying machine as in claim 2, in which the developing means comprises a magnetic brush, the copying machine further comprising bias source means for applying a first bias voltage to the magnetic brush when the drum is rotated at the first speed and applying a second bias voltage to the magnetic brush which is lower than the first bias voltage when the drum is rotated at the second speed.

* * * * *